US005915718A

United States Patent [19]

Dodge

[11] Patent Number: 5,915,718

[45] Date of Patent: Jun. 29, 1999

[54] METHOD AND APPARATUS FOR CANTING AND LIFTING A SNOWBOARD BINDING

[75] Inventor: David J. Dodge, Williston, Vt.

[73] Assignee: The Burton Corporation, Burlington, Vt.

[21] Appl. No.: 08/585,203

[22] Filed: Jan. 8, 1996

[51] Int. Cl.[6] ..... A63C 5/03

[52] U.S. Cl. ..... 280/607; 280/14.2

[58] Field of Search ..... 280/601, 607, 280/608, 609, 14.2, 617, 618

[56] References Cited

U.S. PATENT DOCUMENTS

| | | | |
|---|---|---|---|
| 4,856,808 | 8/1989 | Longoni . | |
| 5,188,388 | 2/1993 | Schweizer | 280/14.2 |
| 5,246,238 | 9/1993 | Brown | 280/11.2 |
| 5,261,689 | 11/1993 | Carpenter et al. . | |
| 5,553,883 | 9/1996 | Erb | 280/14.2 |
| 5,577,755 | 11/1996 | Metzger et al. | 280/14.2 |
| 5,586,779 | 12/1996 | Dawes et al. | 280/14.2 |

FOREIGN PATENT DOCUMENTS

| | | |
|---|---|---|
| 2 669 237 | 5/1992 | France . |
| 2 702 388 | 9/1994 | France . |
| 2 704 439 | 11/1994 | France . |
| 42 09 112 A1 | 1/1992 | Germany . |
| 295 10 981 U1 | 7/1995 | Germany . |
| 9416208 U1 | 9/1995 | Germany . |
| 1-153173 | 6/1989 | Japan . |
| 3016733 | 7/1995 | Japan . |

*Primary Examiner*—Richard M. Camby
*Attorney, Agent, or Firm*—Wolf, Greenfield & Sacks, P.C.

[57] ABSTRACT

A cant/lift having an adjustable cant/lift angle. The cant/lift includes two components that form the adjustable cant/lift angle, and a hub for attaching the components to a snowboard and a binding. The cant/lift enables the rotational orientation of the cant/lift relative to the longitudinal axis of the snowboard to be adjusted.

47 Claims, 12 Drawing Sheets

METHOD AND APPARATUS FOR CANTING AND LIFTING A SNOWBOARD BINDING

BACKGROUND OF THE INVENTION

1. Field of the Invention

The present invention relates to a method and apparatus for canting and lifting a snowboard rider's binding with respect to the plane of a snowboard.

2. Discussion of the Related Art

Snowboard riders typically position their feet approximately perpendicular to the longitudinal axis of the snowboard. However, each rider is different, and many angle their bindings toward the direction of travel. Adjustable snowboard bindings have been developed that enable a rider to adjust the rotational orientation of each binding relative to the board to determine the most desirable riding stance. Such bindings typically have angle markings, often provided on a disc that holds the binding down on the board, so the angle at which the rider's feet are offset from perpendicular to the longitudinal axis of the snowboard can be precisely determined.

Snowboard bindings can be attached flat to the surface of the board. However, some snowboard riders have found it advantageous to either "cant" or "lift" their bindings with respect to the plane of the snowboard. Canting involves tilting or angling the bindings of the snowboard toward each other, thus bringing the rider's knees into an "A" configuration which some rider's find to be a particularly powerful stance. Lifting involves elevating either the toe or heel area of the binding from the surface of the snowboard, such that one is raised with respect to the other. Lifting the rear binding heel and/or the front binding toe also facilitates placing the rider's knees in the "A" configuration.

To facilitate canting and lifting, cant/lifts have been disposed between the snowboard and the binding to angle the binding with respect to the top surface of the board. FIGS. 1 and 2 illustrate an example of a prior art cant/lift 1. The cant/lift 1 is mounted on the snowboard in the location provided for the binding, and includes a metal hub 3 having two sets of screw holes 4 and 5. Screw holes 4 are used to mount the cant/lift on the snowboard via holes in the board provided for directly mounting the binding when no cant/lift is used. The binding is in turn mounted on the cant/lift using threaded screw holes 5. The portion of the cant/lift 6 that surrounds the hub 3 is made of a lightweight plastic, and includes a flat bottom surface 2*a* and a surface 2*b* inclined at an angle A with respect thereto. The thinnest point 2 of the cant/lift 1 is aligned with the longitudinal axis of the snowboard, indicated by the dotted line in FIG. 2, and faces the other binding. Thus, when the cant/lift is mounted under the front binding, the front binding is angled (i.e., canted) toward the rear binding, and vice versa.

The threaded screw holes 5 for receiving the binding are necessarily offset from the holes on the snowboard that would directly receive the binding if the cant/lift was not used, because the portion of the cant/lift hub 3 overlying the snowboard holes is used to form the holes 4 for receiving screws that attach the cant/lift to the board. As a result, when a conventional binding having a hold-down disc with the aforementioned markings used to identify the rotational orientation of the binding is mounted to the cant/lift 1, the markings are not accurate, because they are referenced to the position of the holes in the snowboard. Thus, when mounted to the cant/lift 1, the angle reading on a conventional binding is off by an amount determined by the distance by which the cant/lift binding screw holes 5 are offset from the snowboard binding holes 4. For example, where a 0° binding reading is intended to indicate that the binding is perpendicular to the longitudinal axis of the snowboard, the binding may in fact be rotated 30° toward the direction of travel. As a result, a special binding hold-down disc has been developed for use with the prior art cant/lift to compensate for the angular offset introduced thereby. Although the special disk provides the rider with an accurate reading, it would be preferable to eliminate the need to use a special hold-down disc in connection with the cant/lift.

The cant/lift of FIGS. 1 and 2 can also provide heel or toe lift, depending on the orientation of the binding with respect to the longitudinal axis of the snowboard. For example, if the binding is mounted to the cant/lift so that it is perpendicular to the board's longitudinal axis, cant is provided without lift. However, if the binding is rotated toward the direction of travel, a combination of toe lift and cant is created for the front binding, and a combination of heel lift and cant for the rear binding. Using one set of four snowboard binding holes, the cant/lift 1 can be attached in four different orientations, corresponding to rotation of the cant/lift through 90° increments. However, as a practical matter, the cant/lift is generally only attached with its thinnest point on the center axis of the snowboard and the incline facing the other binding, because the other three possible orientations would create an awkward stance. Thus, the only practical way to alter the cant and lift angles utilizing the cant/lift 1 is to rotate the binding with respect to the cant/lift 1. This is undesirable if the rider prefers the binding to be in a fixed rotational position relative to the board, but also wishes to alter the combination of cant and lift provided by the cant/lift 1.

The prior art cant/lift of FIGS. 1 and 2 has a fixed incline angle A (FIG. 1) that cannot be varied. Thus, to change the cant/lift angle, the rider must replace the cant/lift with another having a different incline angle. This is a time consuming process that necessitates unscrewing the binding from the cant/lift and the cant/lift from the snowboard. Further, to have the option of changing cant/lift angles, a rider must purchase multiple cant/lifts, and must bring them along when riding.

In view of the foregoing, it is an object of the present invention to provide an improved method and apparatus for canting/lifting a snowboard rider's bindings.

SUMMARY OF THE INVENTION

In one illustrative embodiment of the invention, a cant/lift is provided including a hub and two components which are adjustable to form a plurality of cant angles.

In another illustrative embodiment of the invention, a method is provided for changing the rotational orientation of the cant/lift relative to the snowboard, such that the lowest point of the cant is not along the longitudinal axis of the snowboard.

BRIEF DESCRIPTION OF THE DRAWINGS

The invention will be better understood and appreciated from the following detailed description of illustrative embodiments thereof, and the accompanying drawings, in which.

DETAILED DESCRIPTION

Figure 3:
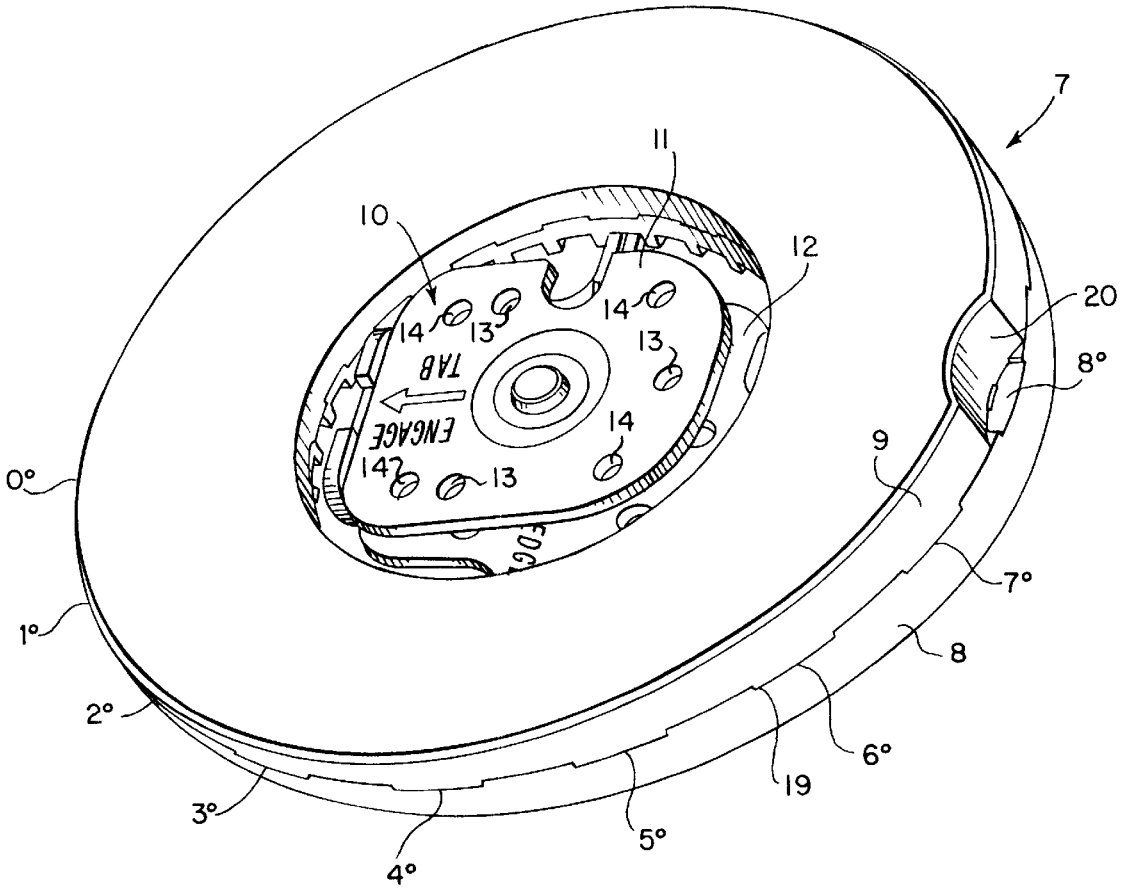
FIG. 3 is a top and side perspective view of one embodiment of the cant/lift according to the present invention.
Figure 4:
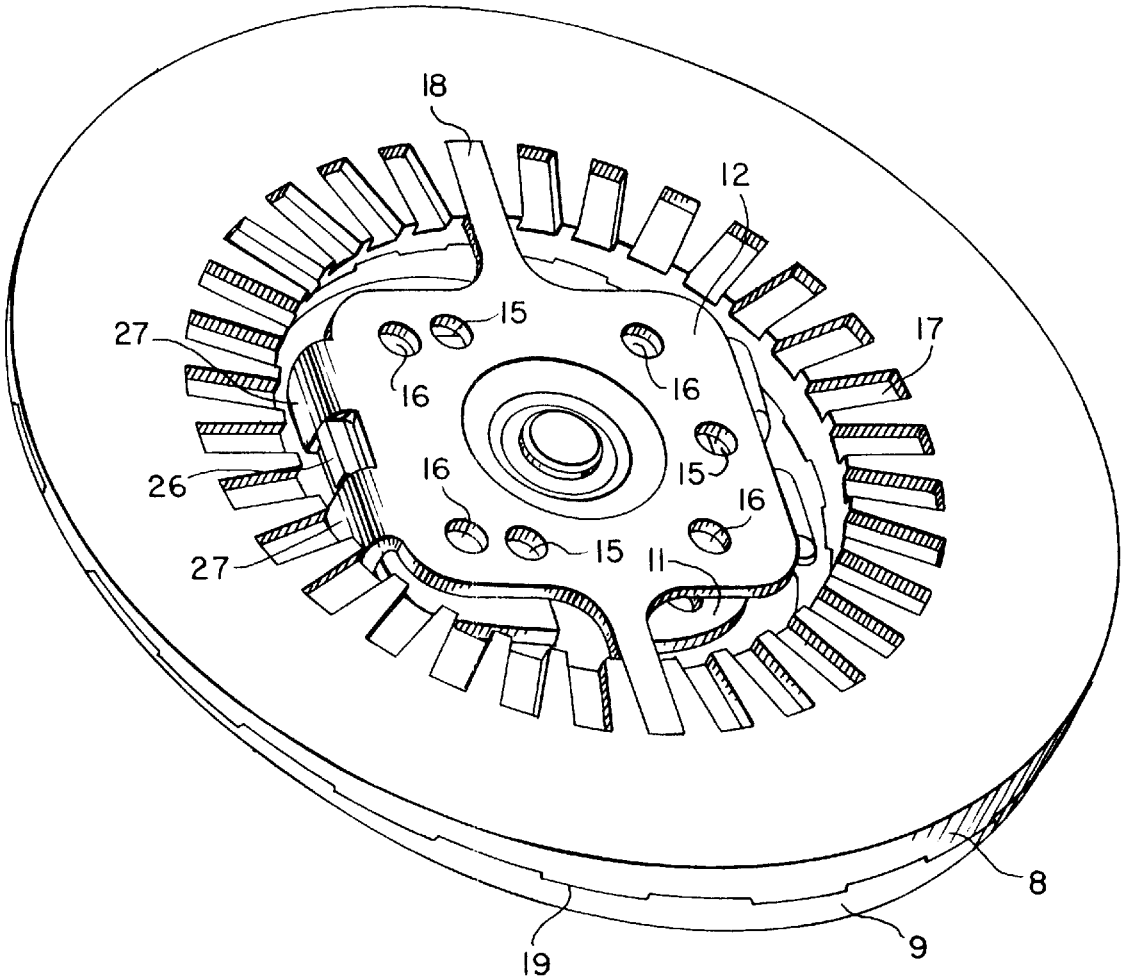
FIG. 4 is a bottom and side perspective view of the cant/lift of FIG. 3.

The present invention relates to a method and apparatus for adjustably canting/lifting a boot binding on a snowboard. FIGS. 3 and 4 respectively show top and bottom views of one embodiment of a cant/lift 7 according to the present invention. The cant/lift comprises a lower disc 8, an upper disc 9, and a hub 10. The hub 10 includes a top plate 11 and a bottom plate 12 that are rotatably mounted together. A concave bushing 21 (see FIGS. 7–8) mounted between the top and bottom plates enables them to be rotated 360° with respect to each other, and also enables the plates to be tilted with respect to each other so that they need not lie in parallel planes, as described in greater detail below. The top plate 11 includes holes 13 and 14 for attaching the binding to the cant/lift, and the bottom plate 12 includes holes 15 and 16 for attaching the cant/lift to the snowboard.

Figure 5:
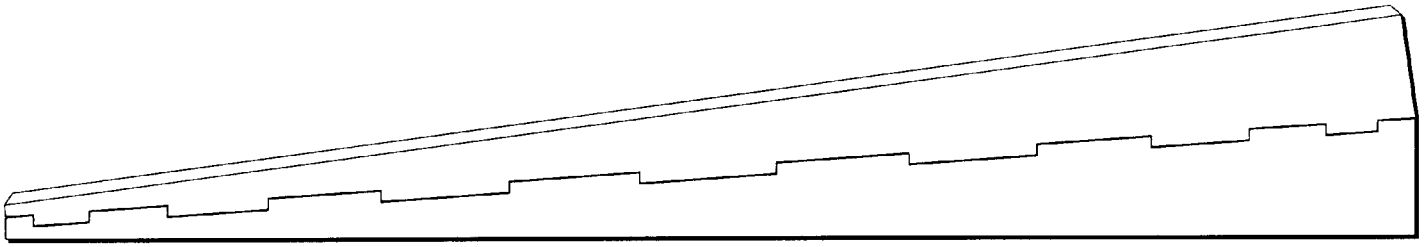
FIG. 5 is a side view of one embodiment of the cant/lift according to the present invention set at an incline angle of 8°.
Figure 6:
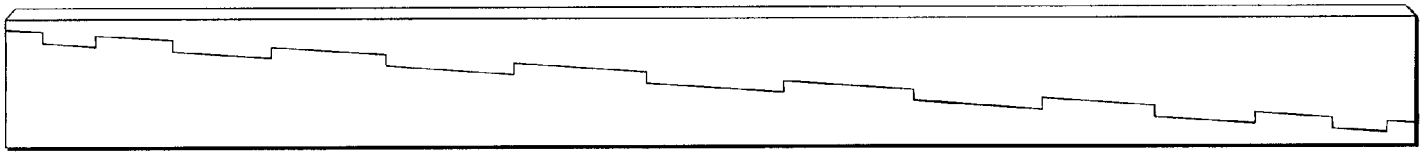
FIG. 6 is a side perspective view of one embodiment of the cant/lift of FIG. 5 set at an angle of 0°.

The lower and upper discs 8 and 9 have teeth 19 that, as seen in FIGS. 3 and 4, mate when the discs are placed together to form a cant/lift wedge similar to the unitary cant/lift 1 of the prior art. The discs can be oriented in a number of relative rotational positions, each corresponding to a different cant/lift angle. In the embodiment shown in the figures, the upper and lower discs can be combined to create cant/lift angles ranging from 0° to 8°, in 1° increments. However, it should be understood that the invention is not limited to this arrangement, and that other angles and increments can alternatively be provided. The variable angle setting is made possible by the wedge shapes of the two discs, which are substantially identical except for compatible indicia provided on each to facilitate reading of the cant/lift angle to which the discs are adjusted, as discussed in greater detail below. FIGS. 5 and 6 show the discs oriented to formed 8° and 0° cant/lift angles, respectively. As is apparent from FIGS. 5 and 6, mating the thickest portions of the two discs forms an 8° cant/lift angle, while mating the thickest portion of one disc with the thinnest portion of the other forms a 0° angle. Intermediate angles are attained by incrementally rotating the discs with respect to one another.

In the embodiment shown in the figures (see FIGS. 7–8), the teeth 19 include alternating spokes of peaks 19*p* and valleys 19*v*. The full range of angular adjustments from 8° and to 8° is achieved through rotation of the upper and lower discs 9 and 8 through only 180°, with the highest and lowest peaks being disposed on opposite ends of the disc. Thus, the disc includes sixteen peaks 19*p* and sixteen valleys 19*v*, with the discs being mirror images on opposite sides of a center line drawn through the highest and lowest peaks. However, it should be understood that other configurations are also possible, and that the full range of angular adjustments need not be performed through rotation of the discs through 180°.

In the embodiment shown in the figures (see FIGS. 7–8), the upper and lower discs include variably sized teeth 19 that mate to allow adjustment of the cant/lift angle of the wedge, and to lock the discs into the relative rotational position that achieves the selected incline angle. Three rows of teeth 19*a*, 19*b* and 19*c* are formed along the thicker sections of the discs, and are separated by cutout sections to reduce the amount of material used in forming the discs. The thinner sections of the discs comprise less material, making cut-out sections less necessary. Thus, for the thinner sections of the disc, fewer rows of teeth may be provided, and at least one of the rows can extend over a greater percentage of the radius of the disc. In fact, as shown at 19*d*, a single tooth extending over the entire radius of the disc can be provided for the lower angular settings. It should be understood that any combination and number of rows of teeth, cut-out portions and solid teeth extending over the entire radius of the disc is possible. Furthermore, although the disc configuration shown in the figures has a number of advantages, the present invention is not limited to this particular configuration, as other configurations may also provide the ability to adjust the incline angle of the cant/lift.

As mentioned above, the discs 8 and 9 are provided with a mechanism for indicating the number of degrees of the cant/lift angle for each of the adjustable settings. In the embodiment shown in the figures (FIG. 3), this mechanism includes an indentation 20 on the upper disc, and nine indicia on the lower disc that respectively correspond to the nine possible angle settings for the cant/lift. It should be understood that the invention is not limited to the particular mechanism disclosed in the drawings for indicating the cant/lift angle setting, and that other configurations are possible.

Once the lower and upper discs 8 and 9 are mated, the two discs are attached to the snowboard as a unitary piece. Initially, the hub 10 is attached to the board using the screw holes 15 or 16 provided in the bottom plate. The two sets of holes are provided so that the cant/lift can be used with a board having either a four-hole or a three-hole binding pattern as discussed below. Access to each of the screw holes 15 or 16 is gained using a feature of the hub described below. The sets of holes 15 or 16 are aligned with corresponding holes in the board that would directly receive a binding if no cant/lift were used.

After the hub 10 is attached to the board, the wedge formed from the mated discs is placed on top of the hub, with hub projections 18 (discussed in detail below) being received in one of a set of grooves 17 on the bottom surface of the lower disc (FIG. 4). The grooves 17 enable the wedge to be positioned at any of a number of rotational positions relative to the longitudinal axis of the board. In the embodiment shown in the drawings, there are thirty-two grooves, permitting 11.25° incremental rotation of the cant/lift. However, it should be understood that the invention is not limited to this particular arrangement, and that greater or fewer angular adjustment increments can alternatively be provided.

When the lowest point of the wedge is not aligned with the longitudinal axis of the board, a combination of cant and lift is provided. Lift is created because one of the heel or toe is elevated with respect to the other. Whether the heel or toe is lifted depends on which direction the cant/lift is rotated relative to the longitudinal axis. Thus, by adjusting the rotational position of the cant/lift wedge with respect to the longitudinal axis of the board, a number of cant/lift combinations are possible. Furthermore, in contrast with the prior art cant/lift of FIGS. 1–2, this adjustability can be achieved without varying the rotational orientation of the binding, which enables the rider to select that adjustment independently. Of course, the rider also has the option of varying the rotational position of the binding on the cant/lift, which provides even more options for achieving a desired combination of cant and lift.

A bottom and side perspective view of the universal cant/lift of FIG. 3 is shown in FIG. 4. As mentioned above, two sets of holes 15 and 16 are provided in the bottom plate 12 for attachment to the face of the snowboard where the binding would be directly attached if no cant/lift was used. Similarly, the top plate 11 is provided with two sets of holes 13 and 14 for attaching the binding to the hub. Bindings and boards are available having a conventional four-hole square pattern for attachment therebetween, as well as the three-hole pattern described in commonly assigned U.S. Pat. No. 5,261,689. The top plate 11 and bottom plate 12 of the hub each is provided with two sets of holes to be compatible with each type of hole pattern. Holes 13 and 15 are respectively provided for attachment to a binding and board having three-hole insert patterns, and holes 14 and 16 are provided for attachment to a binding and board having four-hole insert patterns. Thus, the cant/lift of the present invention includes a single hub that can be used with bindings and boards having either hole pattern.

After the desired angle is set and the cant/lift is placed over the hub in the desired orientation, the binding is attached to the top plate 11 of the hub 10 by screwing the binding hold-down disc into engagement with the top plate. The three-hole pattern holes 13 and four-hole pattern holes 14 are located directly above the corresponding three-hole and four-hole pattern holes 15 and 16 in the bottom plate, and those in the snowboard. Consequently, the binding is attached to the cant/lift in the same rotational position as if it were attached directly to the board. Thus, the angle markings of a conventional binding hold-down disc accurately indicate the rotational position of the binding on the board, making a special hold-down disc unnecessary for use with the cant/lift of the present invention.

The components of the hub 10 will now be described in more detail making reference to the exploded views shown in FIGS. 7 and 8. The hub includes a concave bushing 21 and a mating convex bushing 23 that connect the top and bottom plates 11 and 12. The plates and bushings are held together by a rivet 22 passing through center holes in each. The top plate has a circular, curved depression 24 for receiving the convex bushing 23. The curved depression extends below the plane of the top plate, and is received by a matching depression in the concave bushing 21, which permits the top plate 11 to be rotated with respect to the bottom plate 12, and enables the top plate to tilt in all circumferential directions into planes that are not parallel with the plane of the bottom plate or the snowboard. This is advantageous for reasons explained below.

As stated above, when attaching the cant/lift of the present invention to a snowboard, the hub 10 is first screwed into the snowboard using one of the sets of holes 15 and 16 in the bottom plate, which respectively matches up with either a three-hole or four-hole insert pattern on the snowboard. The bottom plate 12 includes projections 18 extending from two sides. When the bottom plate 12 is aligned with the holes of the snowboard, the projections 18 extend across the board perpendicular to the longitudinal axis and the direction of travel. In the embodiment shown in the figures, projections 18 carry the label "edge" with an arrow to indicate to the user the that the hub is properly oriented when the projections are directed toward the edges of the board. To facilitate screwing the bottom plate to the snowboard, the screw holes of the bottom plate are preferably accessible from above the hub. However, as stated above, it is also desirable to position the holes 13 and 14 in the top plate for receiving the binding directly above the holes in the board. For this reason, an opening (e.g., U-shaped indentation 25), is provided in the top plate 11 to provide access to screw holes 15 and 16 and the corresponding holes in the board. As stated above, the top plate is rotatable with respect to the bottom plate. Thus, by rotating the top plate 11, the U-shaped indentation 25 can be successively positioned above each hole in the bottom plate, allowing a screw to be passed therethrough and into the board.

The top plate includes a tab 26, and the bottom plate includes pairs of projections 27 extending upwardly from the two edges that do not include one of the projections 18. After the bottom plate is attached to the board, the top plate is rotated to a position wherein the tab 26 is mated between the one of the pairs of projections 27 that points along the center axis of the snowboard. When the top plate is oriented in this manner, the sets of holes 13 and 14 in the top plate respectively align with the sets of bottom plate holes 15 and 16. The engagement between the tab 26 and the projection tabs 27 prevents the top plate from rotating relative to the bottom plate once the binding is attached, which stabilizes the binding and ensures that the binding holes 13 and 14 of the top plate remain properly aligned with the snowboard binding holes. To ensure that the tab remains engaged with the projections 27, it is mated with the projections that point along the center axis of the snowboard toward the other binding, which is in the direction of the lower side of the cant/lift wedge.

Figure 9:
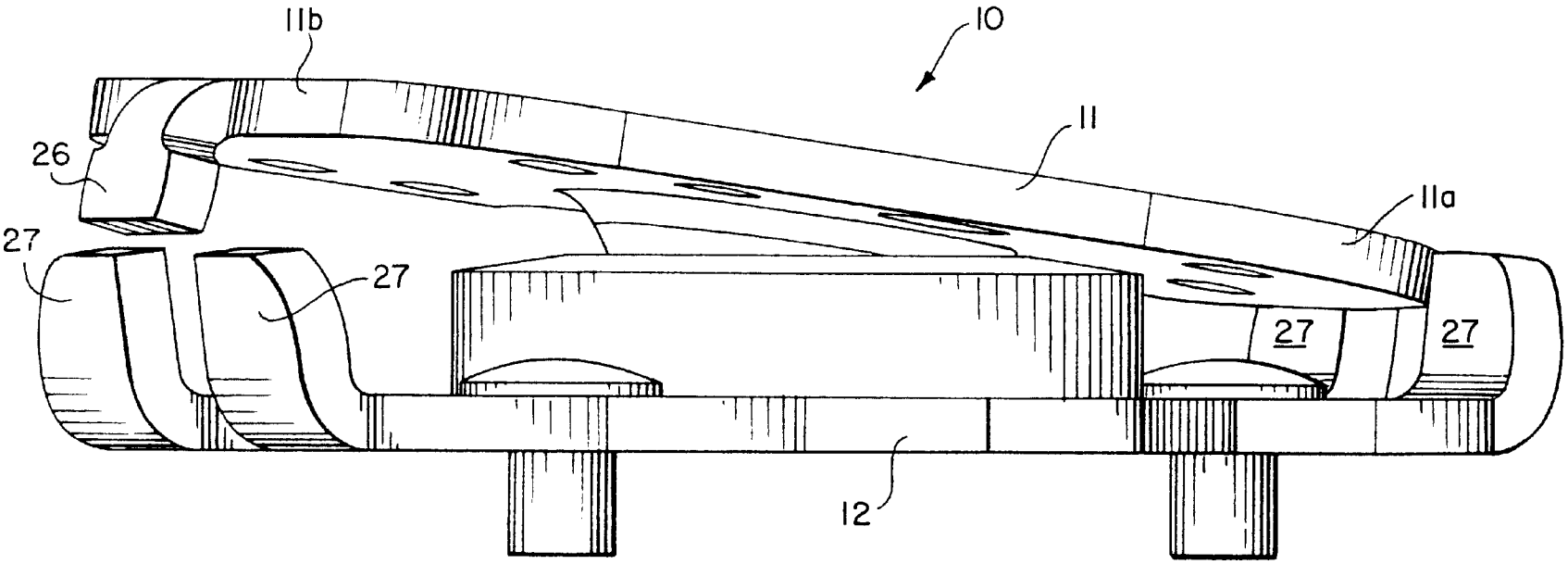
FIG. 9 is a side view of one illustrative embodiment of a hub used in the cant/lift of the present invention.
Figure 10:
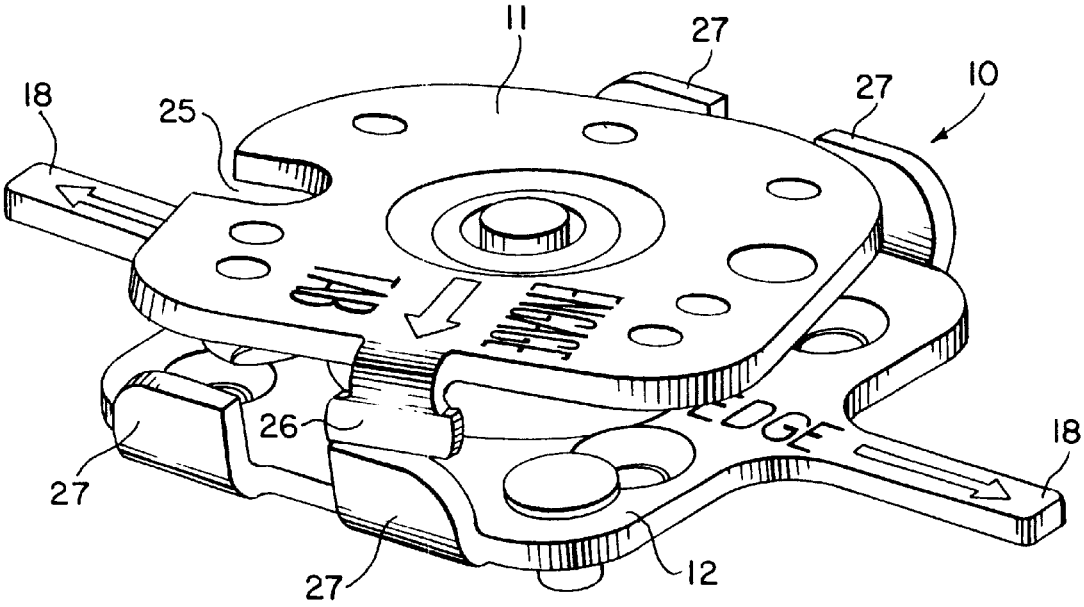
FIG. 10 is a top and side view of the hub of FIG. 9.
Figure 11:
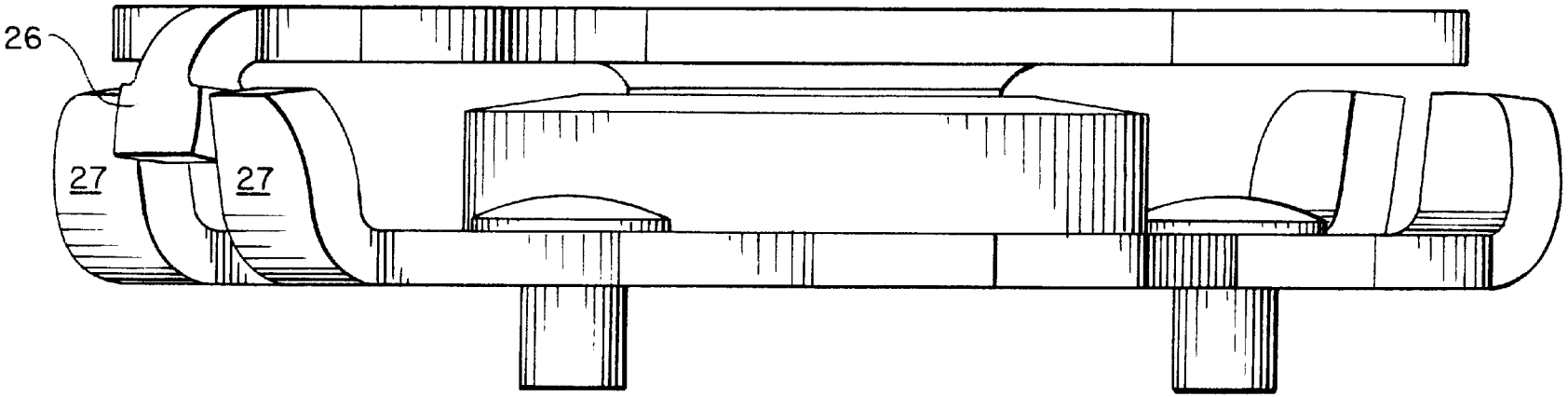
FIG. 11 is a side view of the hub of FIGS. 9–10 set at an incline angle of 0°.
Figure 12:
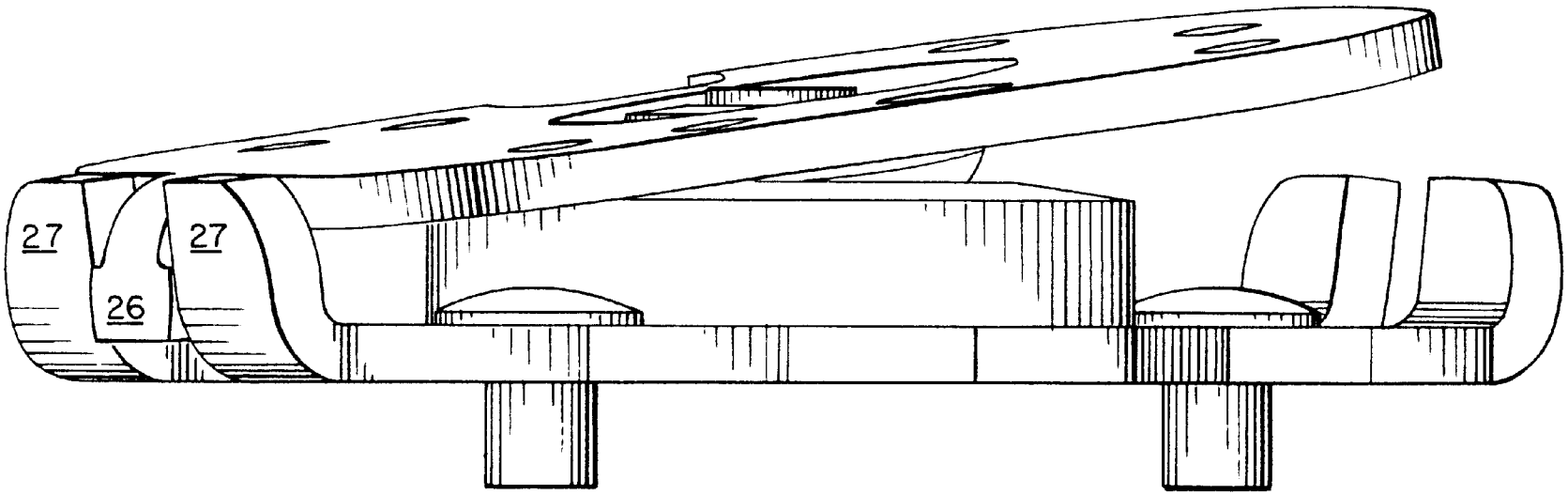
FIG. 12 is a side view of the hub of FIGS. 9–10 set at an incline angle of 8°.

The tab 26 and projections 27 are sized so that when the tab is positioned on the lower side of the wedge, it engages the projections 27 through the full range of angles made available by the adjustable cant/lift. FIG. 11 illustrates the tab 26 engaged when the incline angle is 0°, and FIG. 12 illustrates the tab engaged at an incline angle of 8°. Thus, regardless of the incline angle selected by the rider, the top plate is prevented from rotating relative to the bottom plate to stabilize the binding. However, as discussed above, it is also desirable to enable the top plate to be rotated relative to the bottom plate so that the indentation 25 can be successively positioned above each of the screw holes when attaching the cant/lift hub to the snowboard. Thus, as shown in FIGS. 9–10, the tab 26 can be easily brought out of engagement with the projections 27 by pressing down on the side 11*a* of the top plate opposite the tab 26. When the tab 26 is raised clear of the projections 27, the top plate 11 can be rotated past the projections 27, as seen in FIG. 10, permitting the indentation 25 to be positioned above each of the screw holes 15 and 16. Dimensions of the tab 26 and projections 27 that have been to work well are described making reference to FIG. 13, although it should be appreciated that the present invention is not limited to a hub having the disclosed dimensions, and that other configurations are also possible.

Figure 13A:
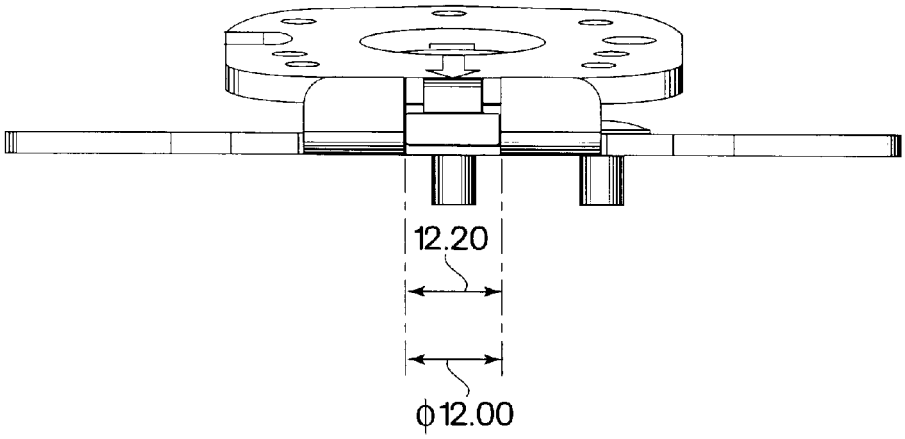
FIGS. 13*a* and 13*b* illustrate several dimensions of the hub of FIGS. 9–10.
Figure 13B:
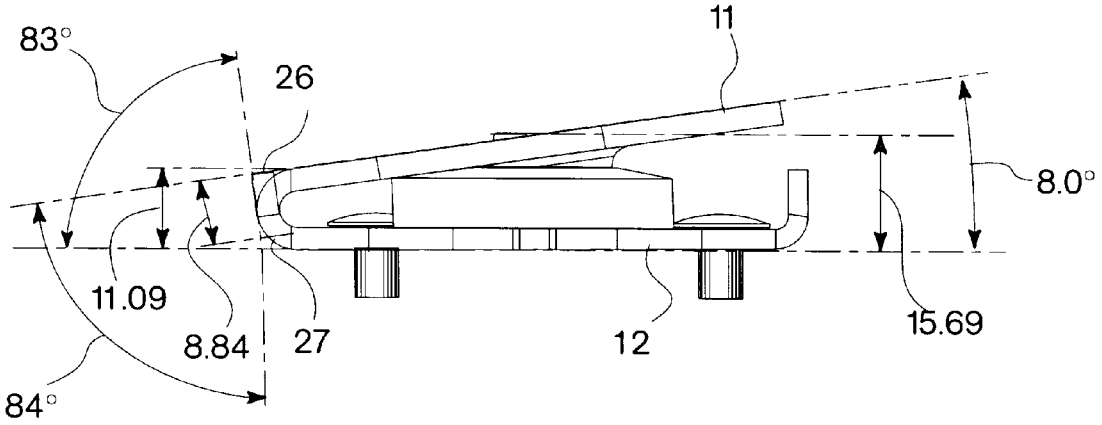

FIGS. 13*a* and 13*b* illustrate several dimensions for the tab 26 and projections 27 that have been found to maintain engagement therebetween for an incline angle within the range of 0°–8°, and to also enable disengagement when rotation of the upper plate is desired. As shown in FIG. 13*a*, the tab 26 can be provided with a width of 12.00 mm, and with the projections can define a slot of 12.20 mm, such that 0.20 mm of clearance is provided therebetween. FIG. 13*b* is a side view of the hub with the upper plate inclined at 8° relative to the lower plate. As shown therein, in one embodiment of the invention the tab 26 extends from the upper surface of the top plate 11 by approximately 8.84 mm, and the projections 27 extend from the lower surface of the lower plate 12 by approximately 11.09 mm, wherein both plates are approximately 2.5 mm thick. It has been found that the desired performance characteristics for the hub can be best achieved by angling the tab relative to the upper plate and the projections 27 relative to the lower plate by angles within a range from 60°–90°. One particular combination that has been found to work well is shown in FIG. 13*b*, wherein the tab 26 is disposed at an angle of approximately 84° from the upper plate, and the projections are disposed at an angle of 83° from the lower plate.

Figure 7:
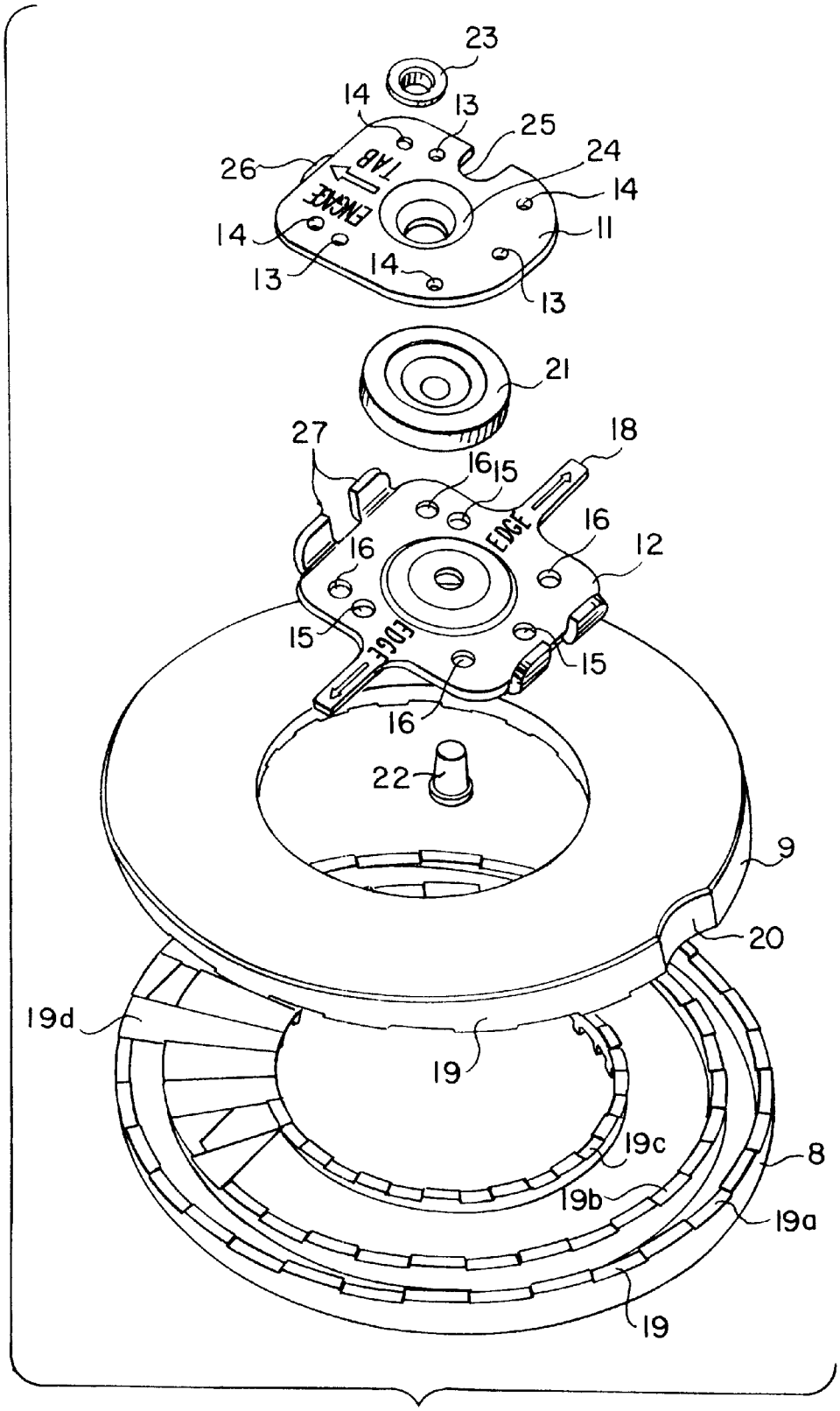
FIG. 7 is an exploded top view of the cant/lift of FIGS. 3 and 4.
Figure 8:
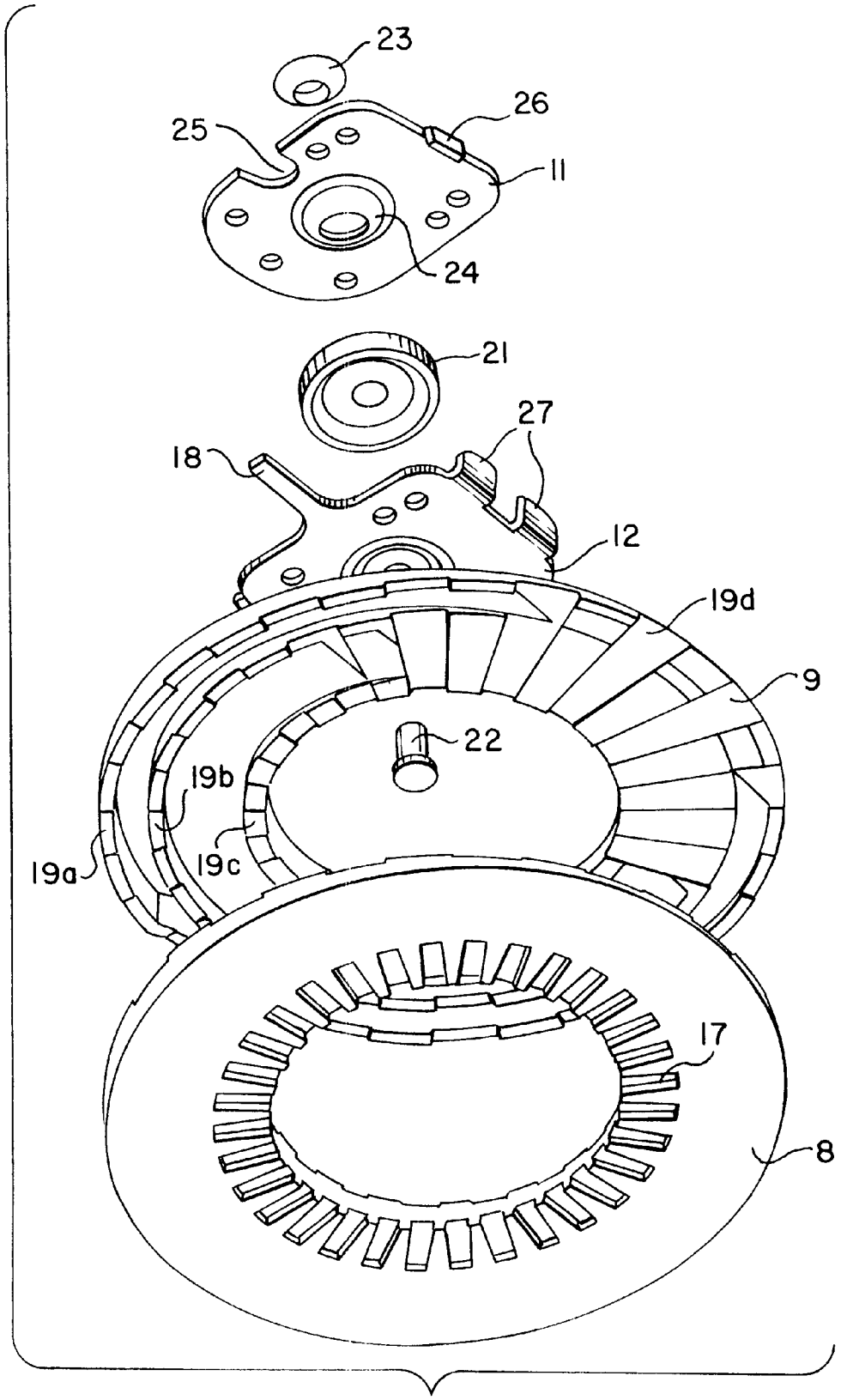
FIG. 8 is an exploded bottom view of the cant/lift of FIGS. 3 and 4.
Figure 14:
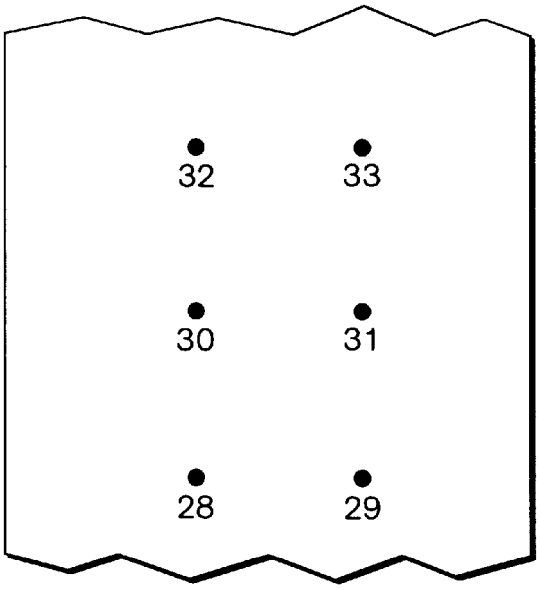
FIG. 14 illustrates a snowboard having a four-hole binding insert pattern.
Figure 15:
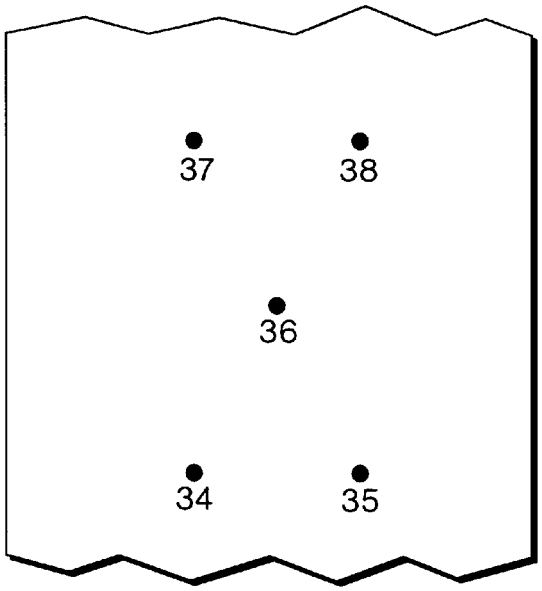
FIG. 15 illustrates a snowboard having a three-hole binding insert pattern.

As shown in FIG. 7 and discussed above, the bottom plate 12 has two pairs of projections 27 disposed on the sides that do not include projections 18. The provision of two sets of projections is advantageous when the hub is used with a three-hole binding pattern that includes multiple sets of binding holes to allow the position of the binding to be varied along the longitudinal axis of the snowboard. For example, FIG. 14 illustrates a snowboard having two sets of holes arranged in a four-hole pattern, so that the binding or cant/lift can be attached to either holes 28–31, or to holes 30–33. To adjust the longitudinal position of the binding along the board or FIG. 14, the cant/lift of the present invention can simply be slid from one group of holes to the other without changing the rotational orientation of the hub with respect to the snowboard. However, with a three-hole pattern such as the one shown in FIG. 15, adjustments from one set of holes to the next to change the longitudinal position of the binding is done by rotating the binding and the hub through 180° from one set of holes 34–36, to the other 36–38. Thus, projections 27 are provided on opposite sides of bottom plate 12 so that no matter which rotational position the hub is placed in relative to the board, a pair of projections 27 points toward the other binding and the lower edge of the cant/lift wedge to lockingly engage tab 26. A single tab 26 is sufficient on top plate 11 because the top plate can be rotated with respect to the bottom plate into the proper position.

After the tab 26 is mated between the pair or projections 27, the binding is mounted to the top plate using one of the sets of screw holes 13, 14 positioned directly above the holes in the board. The tightening down of the binding (not shown) onto the top plate of the hub aligns the top plate in substantially the same plane as the top surface of the upper disc 9 of the cant/lift wedge, with the bottom of the binding resting thereon. The greater the cant/lift angle, the further the tab 26 extends between the tab projections toward the bottom plate, as shown in FIG. 12. As mentioned above, even when the cant/lift angle is set to zero degrees to evenly elevate the rider's bindings off the board, the engage tab 26 is held in place by the projections 27 to stabilize the binding as shown in FIG. 11.

As discussed above, the rotational orientation of the cant/lift wedge can be altered with respect to the longitudinal axis of the snowboard utilizing the grooves 17 on the bottom of the lower disc. The bottom plate 12 of the hub remains fixed to the board, and when the binding is tightened down onto the top plate 11, the top plate tilts relative to the bottom plate so that it sits in the same plane as the top surface of the upper disc, regardless of the rotational orientation of the cant/lift wedge with respect to the longitudinal axis of the board.

Figure 1:
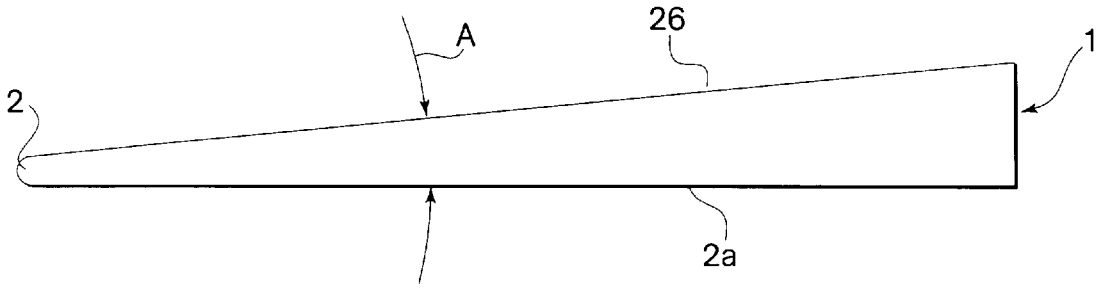
Fig. 1 PRIOR ART
FIG. 1 is a side view of a prior art cant/lift.
Figure 2:
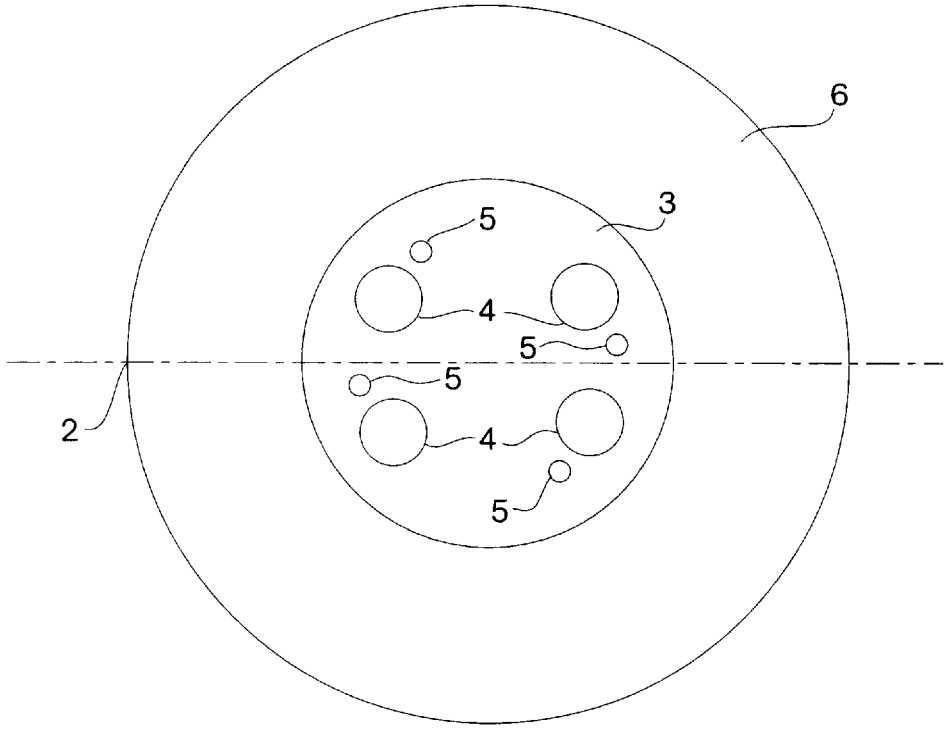
Fig. 2 PRIOR ART
FIG. 2 is a top view of the prior art cant/lift of FIG. 1.

As should be appreciated from the foregoing, the rotational orientation of the cant/lift wedge with respect to the longitudinal axis of the snowboard, and changing the cant/lift angle is much easier to accomplish than with the prior art cant/lift shown in FIGS. 1–2. While the prior art required the user to unscrew the binding and the cant/lift itself to accomplish either type of adjustment, these adjustments can be made using the cant/lift of the present invention by simply removing the binding. After the binding is removed from the cant/lift of the present invention, the upper and lower discs can be lifted off the hub, which remains fixed to the snowboard, and the rider can change either the cant/lift angle, the orientation of the cant/lift wedge with respect to the snowboard, or both. Since the hub remains fixed to the snowboard, a significant and time consuming step is eliminated.

Although the hub and cant/lift of the present invention has been described above as being used in connection with snowboards, it should be understood that the present invention may have other applications. For example, the cant/lift could be used to level an object lying on an incline, by adjusting the cant to the proper angle and placing it under the object.

Having thus described certain embodiments of the present invention, various alterations, modifications, and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalents thereof.

What is claimed is:

1. A device for mounting a binding to a snowboard, the device comprising:

a first plate adapted to mount the device to the snowboard; and a second plate rotatably mounted to the first plate and adapted to mount the binding to the device;

wherein one of the first and second plates includes a projection that is unitary with the one of the first and second plates and is adapted to releasably engage the other of the first and second plates to prevent rotation of the first and second plates with respect to one another.

2. A device for mounting a binding to a snowboard, the device comprising:

a first plate adapted to mount the device to the snowboard;

a second plate adapted to mount the binding to the device; and a joint adapted to rotatably and tiltably mount the second plate relative to the first plate wherein the first and second plates are constructed and arranged to be releasably engageable to prevent rotation of the first and second plates with respect to one another.

3. The device of claim 2, wherein the second plate includes a first mating portion and the first plate includes a second mating portion, the first and second mating portions being adapted to mate to releasably engage the first and second plates in a first orientation.

4. A device for mounting a binding to a snowboard, the device comprising:

a first plate adapted to mount the device to the snowboard;

a second plate adapted to mount the binding to the device; and a joint adapted to rotatably mount the second plate relative to the first plate;

wherein the first and second plates are constructed and arranged to be releasably engageable to prevent rotation of the first and second plates with respect to one another, wherein the second plate includes a first mating portion and the first plate includes a second mating portion, the first and second mating portions being adapted to mate to releasably engage the first and second plates in a first orientation, and wherein the first plate includes a third mating portion, and the first and third mating portions are adapted to mate to releasably engage the first and second plates in a second orientation.

5. The device of claim 4, wherein the second and third mating portions are disposed opposite one another.

6. The device of claim 5, wherein the device is adapted to be used with a cant/lift wedge, and the first plate includes at least one projection adapted to engage and prevent rotation of the cant/lift wedge with respect to the first plate.

7. The device of claim 6, wherein the first plate includes at least one screw hole adapted to mount the device to the snowboard, and the second plate includes an opening, wherein the second plate can be rotated so that the opening is aligned over the at least one screw hole to permit a screw to pass through the opening to be mounted in the at least one screw hole.

8. The device of claim 7, wherein:

the first plate includes a plurality of holes that includes:

a first set of holes, arranged in a first hole pattern, adapted to mount the device to a snowboard having a set of holes arranged in the first hole pattern; and a second set of holes, arranged in a second hole pattern, adapted to mount the device to a snowboard having a set of holes arranged in the second hole pattern; and the second plate includes a plurality of holes that includes:

a third set of holes, arranged in the first hole pattern, adapted to mount a binding having a set of holes arranged in the first hole pattern to the device; and a fourth set of holes arranged in the second hole pattern, adapted to mount a binding having a set of holes arranged in the second hole pattern to the device; and wherein the second plate can be rotated so that the first and second sets of holes of the first plate can be respectively aligned with the third and fourth sets of holes of the second plate.

9. The device of claim 8, in combination with the cant/lift wedge, wherein the cant/lift wedge is adjustable to form a plurality of cant/lift angles.

10. The combination of claim 9, wherein the cant/lift wedge includes markings that indicate the cant/lift angle formed thereby.

11. The combination of claim 10, wherein the adjustable cant/lift includes a plurality of grooves and the at least one projection is received in a corresponding one of the plurality of grooves, whereby a rotational orientation of the cant/lift relative to the snowboard can be adjusted by rotating the cant/lift wedge so that the at least one projection is received in another one of the plurality of grooves.

12. The device of claim 2, wherein the device is adapted to be used with a cant/lift wedge, and the first plate includes at least one projection adapted to engage and prevent rotation of the cant/lift wedge with respect to the first plate.

13. The device of claim 2, wherein the first plate includes at least one screw hole adapted to mount the device to the snowboard, and the second plate includes an opening, wherein the second plate can be rotated so that the opening is aligned over the at least one screw hole to permit a screw to pass through the opening to be mounted in the at least one screw hole.

14. The device of claim 2, wherein:

the first plate includes a plurality of holes that includes:

a first set of holes, arranged in a first hole pattern, adapted to mount the device to a snowboard having a set of holes arranged in the first hole pattern; and a second set of holes, arranged in a second hole pattern, adapted to mount the device to a snowboard having a set of holes arranged in the second hole pattern; and the second plate includes a plurality of holes that includes:

a third set of holes, arranged in the first hole pattern, adapted to mount a binding having a set of holes arranged in the first hole pattern to the device; and a fourth set of holes arranged in the second hole pattern, adapted to mount a binding having a set of holes arranged in the second hole pattern to the device; and wherein the second plate can be rotated so that the first and second sets of holes of the first plate can be respectively aligned with the third and fourth sets of holes of the second plate.

15. The device of claim 12, in combination with the cant/lift wedge, wherein the cant/lift wedge is adjustable to form a plurality of cant/lift angles.

16. The combination of claim 15, wherein the cant/lift wedge includes markings that indicate the cant/lift angle formed thereby.

17. An apparatus comprising:

a device for mounting a binding to a snowboard, the device comprising:

a first plate adapted to mount the device to the snowboard, the first plate including at least one projection;

a second plate adapted to mount the binding to the device; and a joint adapted to rotatably mount the second plate relative to the first plate; wherein the first and second plates are constructed and arranged to be releasably engageable to prevent rotation of the first and second plates with respect to one, and a cant/lift wedge that includes a plurality of grooves to prevent rotation of the cant/lift wedge with respect to the first plate, wherein the at least one projection is received in a corresponding one of the plurality of grooves, whereby a rotational orientation of the cant/lift relative to the snowboard can be adjusted by rotating the cant/lift wedge so that the at least one projection is received in another one of the plurality of grooves.

18. The device of claim 2, wherein the second plate includes means for releasably engaging the first plate to the second plate.

19. A device for mounting a binding to a snowboard, the device comprising:

a first plate adapted to mount the device to the snowboard; and a second plate rotatably and tiltably mounted to the first plate and adapted to mount the binding to the device;

wherein one of the first and second plates includes a projection adapted to releasably engage the other of the of the first and second plates to prevent rotation of the first and second plates with respect to one another.

20. The device of claim 19, wherein the other of first and second plates includes a first mating portion adapted to mate with the projection to prevent rotation of the first and second plates with respect to one another in a first orientation.

21. The device of claim 20, wherein the other of the first and second plates further includes a second mating portion adapted to mate with the projection to prevent rotation of the first and second plates with respect to one another in a second orientation.

22. The device of claim 21, wherein the first mating portion and the second mating portion are disposed opposite one another.

23. The device of claim 22, wherein the device is adapted to be used with a cant/lift wedge, and the first plate includes at least one projection adapted to engage and prevent rotation of the cant/lift wedge with respect to the first plate.

24. The device of claim 23, wherein the first plate includes at least one screw hole adapted to mount the device to the snowboard, and the second plate includes an opening, wherein the second plate can be rotated so that the opening is aligned over the at least one screw hole to permit a screw to pass through the opening to be mounted in the at least one screw hole.

25. The device of claim 24, wherein:

the first plate includes a plurality of holes that includes:

a first set of holes, arranged in a first hole pattern, adapted to mount the device to a snowboard having a set of holes arranged in the first hole pattern; and a second set of holes, arranged in a second hole pattern, adapted to mount the device to a snowboard having a set of holes arranged in the second hole pattern; and the second plate includes a plurality of holes that includes:

a third set of holes, arranged in the first hole pattern, adapted to mount a binding having a set of holes arranged in the first hole pattern to the device; and a fourth set of holes arranged in the second hole pattern, adapted to mount a binding having a set of holes arranged in the second hole pattern to the device; and wherein the second plate can be rotated so that the first and second sets of holes of the first plate can be respectively aligned with the third and fourth sets of holes of the second plate.

26. The device of claim 25, in combination with the cant/lift wedge, wherein the cant/lift wedge is adjustable to form a plurality of cant/lift angles.

27. The combination of claim 26, wherein the cant/lift wedge includes markings that indicate the cant/lift angle formed thereby.

28. The combination of claim 27, wherein the adjustable cant/lift includes a plurality of grooves and the at least one projection is received in a corresponding one of the plurality of grooves, whereby a rotational orientation of the cant/lift relative to the snowboard can be adjusted by rotating the cant/lift wedge so that the at least one projection is received in another one of the plurality of grooves.

29. The device of claim 19, wherein the device is adapted to be used with a cant/lift wedge, and the first plate includes at least one projection adapted to engage and prevent rotation of the cant/lift wedge with respect to the first plate.

30. The device of claim 19, wherein the first plate includes at least one screw hole adapted to mount the device to the snowboard, and the second plate includes an opening, wherein the second plate can be rotated so that the opening is aligned over the at least one screw hole to permit a screw to pass through the opening to be mounted in the at least one screw hole.

31. A device for mounting a binding to a snowboard, the device comprising:

a first plate adapted to mount the device to the snowboard; and a second plate rotatably mounted to the first plate and adapted to mount the binding to the device;

wherein one of the first and second plates includes a projection adapted to releasably engage the other of the of the first and second plates to prevent rotation of the first and second plates with respect to one another;

wherein the first plate includes a plurality of holes that includes:

a first set of holes, arranged in a first hole pattern, adapted to mount the device to a snowboard having a set of holes arranged in the first hole pattern; and a second set of holes, arranged in a second hole pattern, adapted to mount the device to a snowboard having a set of holes arranged in the second hole pattern;

wherein the second plate includes a plurality of holes that includes:

a third set of holes, arranged in the first hole pattern, adapted to mount a binding having a set of holes arranged in the first hole pattern to the device; and a fourth set of holes arranged in the second hole pattern, adapted to mount a binding having a set of holes arranged in the second hole pattern to the device; and wherein the second plate can be rotated so that the first and second sets of holes of the first plate can be respectively aligned with the third and fourth sets of holes of the second plate.

32. The device of claim 29, in combination with the cant/lift wedge, wherein the cant/lift wedge is adjustable to form a plurality of cant/lift angles.

33. The combination of claim 32, wherein the cant/lift wedge includes markings that indicate the cant/lift angle formed thereby.

34. An apparatus comprising:

a device for mounting a binding to a snowboard, the device comprising:

a first plate adapted to mount the device to the snowboard, the first plate including at least one projection; and a second plate rotatably mounted to the first plate and adapted to mount the binding to the device;

wherein one of the first and second plates includes a projection adapted to releasably engage the other of the of the first and second plates to prevent rotation of the first and second plates with respect to one another; and a cant/lift wedge that includes a plurality of grooves to prevent rotation of the cant/lift wedge with respect to the first plate, wherein the at least one projection is received in a corresponding one of the plurality of grooves, whereby a rotational orientation of the cant/lift relative to the snowboard can be adjusted by rotating the cant/lift wedge so that the at least one projection is received in another one of the plurality of grooves.

35. A device for mounting a binding to a snowboard, the device adapted to be used with a cant/lift wedge, the device comprising:

a first plate adapted to mount the device to the snowboard, wherein the first plate includes at least one projection adapted to engage and prevent rotation of the cant/lift wedge with respect to the first plate;

a second plate adapted to mount the binding to the device; and a joint adapted to movably mount the second plate to the first plate.

36. The device of claim 35, in combination with the cant/lift wedge, the cant/lift wedge including a plurality of grooves wherein the at least one projection is received in a corresponding one of the plurality of grooves, whereby a rotational orientation of the cant/lift relative to the snowboard can be adjusted by rotating the cant/lift wedge so that the at least one projection is received in another one of the plurality of grooves.

37. The combination of claim 36, wherein the first plate includes at least one screw hole adapted to mount the device to the snowboard, and the second plate includes an opening, wherein the second plate can be rotated so that the opening is aligned over the at least one screw hole to permit a screw to pass through the opening to be mounted in the at least one screw hole.

38. The combination of claim 37, wherein:

the first plate includes a plurality of holes that includes:

a first set of holes, arranged in a first hole pattern, adapted to mount the device to a snowboard having a set of holes arranged in the first hole pattern; and a second set of holes, arranged in a second hole pattern, adapted to mount the device to a snowboard having a set of holes arranged in the second hole pattern; and the second plate includes a plurality of holes that includes:

a third set of holes, arranged in the first hole pattern, adapted to mount a binding having a set of holes arranged in the first hole pattern to the device; and a fourth set of holes arranged in the second hole pattern, adapted to mount a binding having a set of holes arranged in the second hole pattern to the device; and wherein the second plate can be rotated so that the first and second sets of holes of the first plate can be respectively aligned with the third and fourth sets of holes of the second plate.

39. The combination of claim 38, wherein the cant/lift wedge is adjustable to form a plurality of cant/lift angles.

40. The combination of claim 39, wherein the cant/lift wedge includes markings that indicate the cant/lift angle formed thereby.

41. The device of claim 35, wherein the first plate includes at least one screw hole adapted to mount the device to the snowboard, and the second plate includes an opening, wherein the second plate can be rotated so that the opening is aligned over the at least one screw hole to permit a screw to pass through the opening to be mounted in the at least one screw hole.

42. The device of claim 35, wherein:

the first plate includes a plurality of holes that includes:

a first set of holes, arranged in a first hole pattern, adapted to mount the device to a snowboard having a set of holes arranged in the first hole pattern; and a second set of holes, arranged in a second hole pattern, adapted to mount the device to a snowboard having a set of holes arranged in the second hole pattern; and the second plate includes a plurality of holes that includes:

a third set of holes, arranged in the first hole pattern, adapted to mount a binding having a set of holes arranged in the first hole pattern to the device; and a fourth set of holes arranged in the second hole pattern, adapted to mount a binding having a set of holes arranged in the second hole pattern to the device; and wherein the second plate can be rotated so that the first and second sets of holes of the first plate can be respectively aligned with the third and fourth sets of holes.

43. The device of claim 35, in combination with the cant/lift wedge, wherein the cant/lift wedge is adjustable to form a plurality of cant/lift angles.

44. The combination of claim 43, wherein the cant/lift wedge includes markings that indicate the cant/lift angle formed thereby.

45. A device for mounting a binding to a snowboard, the device comprising:

a first plate including at least one screw hole adapted to mount the device to the snowboard;

a second plate rotatably mounted to the first plate and including:

at least one screw hole for mounting the binding to the second plate; and an opening;

wherein the second plate can be rotated so that the opening is aligned over the at least one screw hole to permit a screw to pass through the opening to be mounted in the at least one screw hole, the opening having a diameter larger than a diameter of the screw.

46. The device of claim 45, wherein:

the first plate includes a plurality of holes that includes:

a first set of holes, arranged in a first hole pattern, adapted to mount the device to a snowboard having a set of holes arranged in the first hole pattern; and a second set of holes, arranged in a second hole pattern, adapted to mount the device to a snowboard having a set of holes arranged in the second hole pattern; and the second plate includes a plurality of holes that includes:

a third set of holes, arranged in the first hole pattern, adapted to mount a binding having a set of holes arranged in the first hole pattern to the device; and a fourth set of holes arranged in the second hole pattern, adapted to mount a binding having a set of holes arranged in the second hole pattern to the device; and wherein the second plate can be rotated so that the first and second sets of holes of the first plate can be respectively aligned with the third and fourth sets of holes of the second plate.

47. An apparatus comprising:

a device for mounting a binding to a snowboard, the device comprising:

a first plate including at least one screw hole adapted to mount the device to the snowboard;

a second plate rotatably mounted to the first plate and including at least one screw hole for mounting the binding to the second plate and an opening; wherein the second plate can be rotated so that the opening is aligned over the at least one screw hole of the first plate to permit a screw to pass through the opening to be mounted in the at least one screw hole of the first plate; and a cant/lift wedge capable of forming a plurality of cant/lift angles, and includes markings that indicate the cant/lift angle formed thereby.

* * * * *